United States Patent [19]

Spitz

[11] Patent Number: 4,504,987

[45] Date of Patent: Mar. 19, 1985

[54] MATTRESS SUPPORT MECHANISM FOR FOLDING SOFA-BED

[75] Inventor: Melvin P. Spitz, Beverly Hills, Calif.

[73] Assignee: Bedline Manufacturing Company, Whittier, Calif.

[21] Appl. No.: 460,959

[22] Filed: Jan. 25, 1983

[51] Int. Cl.[3] ..... A47C 17/04

[52] U.S. Cl. ..... 5/13; 5/28; 5/29

[58] Field of Search ..... 5/13, 28–36, 5/233

[56] References Cited

U.S. PATENT DOCUMENTS

| | | | |
|---|---|---|---|
| 2,352,989 | 7/1944 | Woller | 5/13 |
| 2,742,653 | 4/1956 | Woller | 5/13 |
| 3,281,871 | 11/1966 | Katz | 5/13 |
| 3,431,567 | 3/1969 | Spitz et al. | 5/13 |
| 3,952,344 | 4/1976 | Cycowicz et al. | 5/13 |
| 4,068,328 | 1/1978 | Gerth | 5/13 |
| 4,173,803 | 11/1979 | Kennedy | 5/13 |
| 4,381,570 | 5/1983 | Schneider | 5/13 |
| 4,398,312 | 8/1983 | Duff | 5/13 |

*Primary Examiner*—Alexander Grosz
*Assistant Examiner*—Vinh Luong
*Attorney, Agent, or Firm*—Whann & McManigal

[57] ABSTRACT

A folding sofa-bed or the like structure having a plurality of frame sections including a body section, pivotally interconnected in end-to-end relation for movement into an extended planar position to form a bed, and into a folded position to form a sofa-seat, and wherein the frame section and the body section in particular are provided with a flexible mattress supporting fabric having springs normally biasing the fabric and limiting it to a predetermined amount of sag under the weight of an occupant. Further sag control is obtained by utilizing one or more substantially rigid elongate transversely extending members which are normally supported by springs in a relatively relaxed and inactive position underlying the fabric of the body section, when the frame sections are in a seat forming position, but which are activated by a control linkage, responsive to movement of the frame sections to a bed forming position, whereby the rigid members will be moved into engagement with the mattress supporting fabric of the body section and its support springs stressed so as to provide a taut and more firm mattress support and thereby reduce the sag produced by the weight of the occupant, and tendency to sag towards the center of the bed.

1 Claim, 5 Drawing Figures

MATTRESS SUPPORT MECHANISM FOR FOLDING SOFA-BED

BACKGROUND OF THE INVENTION

The present invention relates generally to a foldable sofa-bed, davenport or the like having a sectionalized bed-frame which may be folded to one position to provide a sofa seat, and unfolded to an extended position to form a bed.

Foldable sofa-bed constructions of the aforementioned type are conventionally known and, as exemplified by U.S. Pat. No. 3,245,091, usually embody a mattress supporting flexible fabric structure or combination of flexible fabric structures on the foldable frame sections, to provide different flexible biasing characteristics in the seat forming section when in a folded position, and the body support section when in an extended bed forming position.

Basically, there are two important operating characteristics which should be considered with respect to the mattress supporting fabric, particularly in the folded seat forming section and the body supporting section in the unfolded and extended bed forming position. Thus, it is desirable that in the folded seat forming position, the mattress supporting fabric in the sections should cooperate in such a manner that the mattress-supporting fabric in the uppermost seat forming section should remain relatively taut, while in the other sections the supporting fabric should be relatively relaxed, in order to avoid upward crowning of the mattress in the seat forming section and the tendency to lift the seat cushions and thereby detract from the appearance of the sofa. In the extended bed forming position, it is desirable that the mattress supporting fabric, especially in the body or trunk section where most of the weight of a bed occupant is concentrated, should be maintained relatively as taut and firm as possible, and prevent sagging towards the center of the bed.

In the referenced patent, there is disclosed a structural arrangement which effectively addresses and eliminates the crowning effect in the folded seating position. However, in the presently known sofa sleeper mechanisms, the manufacturers have been unable to successfully achieve an acceptable degree of firm and non-sagging support for the mattress in an open bed position.

In the present invention, it is proposed to provide one or more transversely extending rigid rods or bars which are positioned below the mattress supporting fabric of the trunk or body frame section, and are supported at their end extremities by coiled springs which are relatively relaxed in the seat forming folded position. An actuating linkage is provided to laterally shift the rods or bars, in response to movement of the sections to an extended bed forming position, so as to tension the supporting springs and move the rods or bars into engagement with the underside of the associated mattress supporting fabric and thus effectively increase the biasing resistance to the sag under the weight of a bed occupant, as well as the tendency to sag towards the center of the bed.

SUMMARY OF THE INVENTION

While the present invention relates generally to articulated foldable sofa-bed mechanisms, it is particularly concerned with improvements in the operating characteristics of the mattress supporting fabric in the section which functions to support the body of an occupant, when the sofa-bed is in an unfolded bed forming position.

Accordingly, it is one object of the herein described invention to provide a sectionalized foldable and extendable sofa-bed structure having a variable mattress supporting fabric which is operative in an extended bed forming position to provide increased tautness and oppose a tendency of the mattress supporting fabric to sag towards the center of the bed under the weight of an occupant.

Another object is to provide in a foldable sofa-bed structure having a spring tensioned mattress supporting fabric, unique means which will be responsive to movement of the sofa-bed structure to a bed forming position and operate in a manner to augment the spring tension of the supporting fabric in a body supporting section of the sofa-bed structure.

Still another object is to provide in a multi-sectioned foldable sofa-bed frame structure having a spring tensioned mattress supporting fabric in a body supporting section thereof, supplementary spring tensioned means underlying the fabric in the body supporting section and normally being in a relaxed, non-effective state, when the sofa-bed is in a folded seat forming position, and in which a connecting linkage is operative in response to unfolding movement of the sections to bed forming position, to activate the supplementary spring tensioned means into coacting relationship with the associated mattress supporting fabric and thereby jointly provide a greater opposition to any tendency to sag under the weight of an occupant.

Further objects of the invention will be brought out in the following part of the specification, wherein detailed description is for the purpose of fully disclosing the invention without placing limitations thereon.

DESCRIPTION OF A PREFERRED EMBODIMENT

Figure 1:
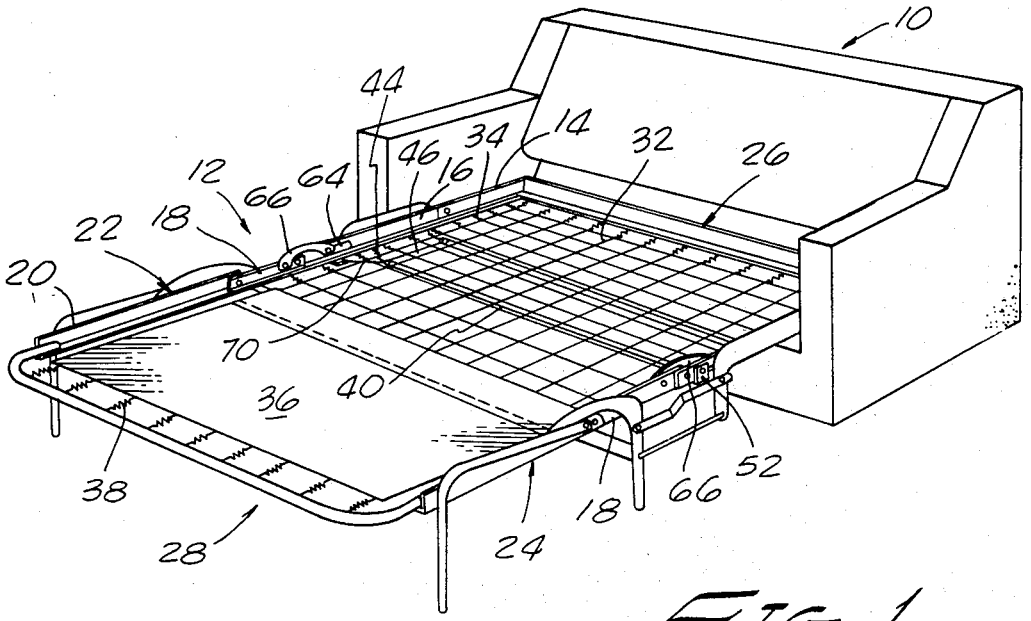
FIG. 1 is a perspective view of a sofa-bed or davenport according to the present invention, the bedframe being shown in an extended bed forming position.

Referring more specifically to the drawings, for illustrative purposes, the present invention is shown as being incorporated in a sofa or davenport frame structure, as generally indicated by the numeral 10, of boxlike upholstered construction such as usually supplied by a furniture manufacture, and which is adapted to mountingly receive a foldable bed-frame unit, as generally indicated by the numeral 12.

The bed-frame unit 12 is conventional and includes a plurality of pivotally interconnected transversely extending frame sections which are arranged in end-to-end relation. More specifically, the connected frame sections comprise a head section 14, a body section 16, an intermediate section 18 and a foot section 20. These sections, as thus arranged form a foldable bed-frame structure which may be extended to provide a substantially rectangular frame structure having articulated side rails as generally indicated by the numerals 22 and 24, respectively, and which are interconnected by a transversely extending head end member 26 and a foot end member 28.

Figure 3:
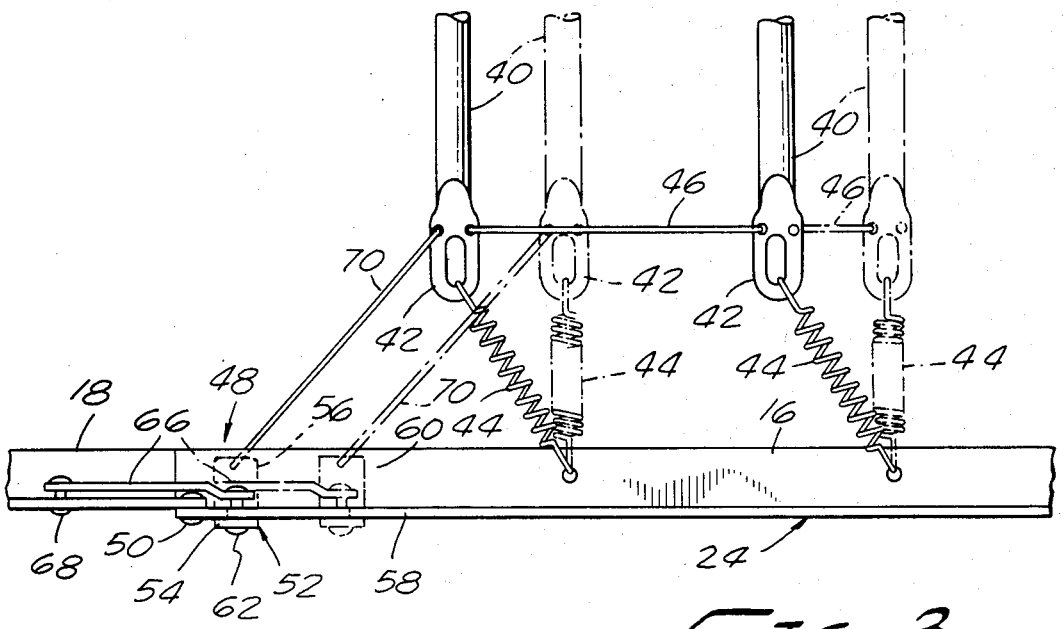
FIG. 3 is an enlarged fragmentary plan view disclosing structural and operational details of the invention.
Figure 4:
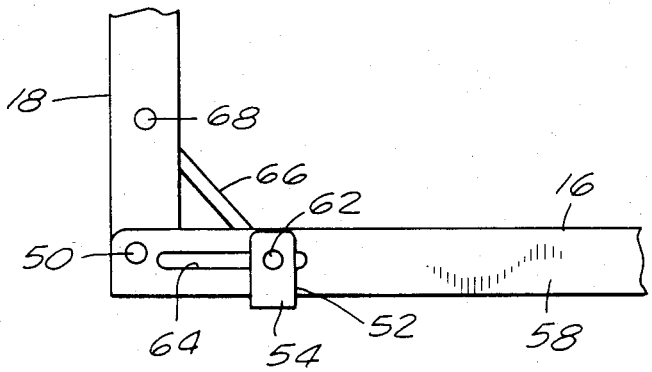
FIG. 4 is a fragmentary side elevational view of two pivotally connected sofa-bed sections, and showing the operative positions of the control linkage members, when the sections are in folded relation.
Figure 5:
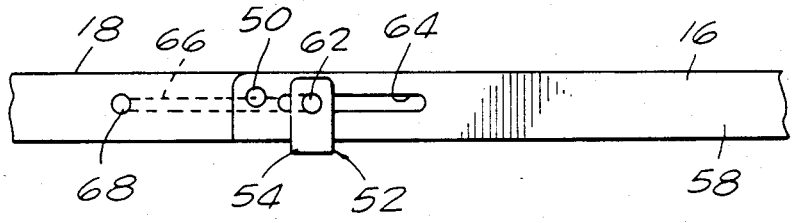
FIG. 5 is a similar view showing the positions of the control linkage members, when the sections are in an extended bed forming position.

Flexible fabric supporting means for a bed mattress 30, as shown in FIG. 3, is provided within the bed-frame structure, and comprises an interconnected link fabric section 32 which is stretched within the head section 14, body section 16 and intermediate section 18 and connected to the respective side rails 22 and 24 and head end member 26 by means of coiled springs 34 which serve to tension the fabric section.

The foot section is provided with a fabric section 36 of suitable material such as a relatively heavy canvas which is not connected to the side rails but is connected along an end edge to the foot end member 28 by plurality of coiled springs 38. The opposite edge of the fabric section 36 may be secured by an elongate edge loop which is adapted to receive a transversely extending bar member or part which extends transversely between the side rail portions of the intermediate section 18. It is to be understood, however, that in some commercial sofa-bed embodiments, the fabric section 36 may be similarly constructed to that of the linked fabric 32 and attached to the side rails by coiled springs.

Figure 2:
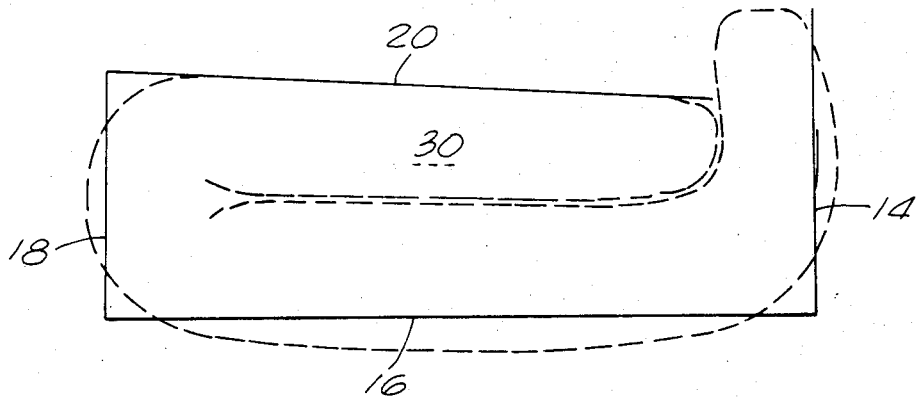
FIG. 2 is a view diagramatically illustrating the folded seat forming position of the folded sofa-bed structure, and showing in dashed lines the operative bulging effect of the front, back and bottom mattress portions that so materially contributes to the obtainment of a desirable high-quality seating result.

Having reference to FIG. 2, it will be seen that in the folded seat forming position of the sofa-bed structure, the mattress supporting fabric surrounds and confiningly encompasses the folded mattress, and in the foot section provides a top seat supporting surface which remains relatively taut, while in the head section, body section and intermediate section the fabric assumes a relative slackness which prevents undesirable upward crowning in the seat forming section that would tend to lift the seat cushions and detract from the appearance of the sofa. Moreover, because of the relative slackness in the mattress supporting fabric in the sections 14, 16 and 18, the mattress tends to bulge outwardly, as indicated in broken lines, when sitting on the sofa, thus contributing to a relatively soft highly desirable quality of seating.

On the other hand, in sofa-bed sleeper mechanisms, as thus far described, it has been found that the presently known mattress supporting fabrics do not provide an acceptable degree of firm, non-sagging support for the mattress in an open bed position, and especially in the body or trunk section 16 where most of the weight of the bed occupant is concentrated. It is desirable that in this section the mattress supporting fabric should be as firm as possible in the open bed position, and non-sagging toward the center of the bed.

In the present invention, this objective is accomplished by means of a controlled auxiliary arrangement of elements for supplementing and augmenting the action of the mattress supporting fabric in the body section 16, when the sofa-bed structure is moved into a bed forming position.

As best shown in FIGS. 1 and 3–5, one or more elongate, rigid rod or bar members 40 are supported in transverse extending positions below the mattress supporting fabric in the body section. These bars may be constructed of any suitable material and may vary as to design and configuration. As shown, the rods are of tubular construction and are formed with end eyelets 42 respectively for the connection of coiled springs 44 by means of which the rod may be suspended from the opposite side rails 22 and 24 of the body section 16. The springs 44 are of a relaxed length such that the rod 40 will be disengaged and ineffectual with respect to the mattress supporting fabric, when the sofa-bed is in a folded position. When more than one rod 40 is utilized, the rods are interconnected at their ends for cooperative movement by means of end spacer links 46.

Operating linkages, as generally indicated by the numeral 48, are provided at the opposite ends of the rod members 40 for moving the rods into stressed cooperative relationship with the overlying mattress supporting fabric in response to movement of the sofa-bed structure into a bed forming position. As best shown in FIG. 3, the side rail portions of the body section and intermediate section are fabricated from angle-iron extrusions and have their upstanding flanges swingably interconnected by a pivot 50.

More specifically, the operating linkage 48 comprises an angle-bracket 52 which is positioned in spaced relation to the pivot 50 and with its right-angled legs 54 and 56 in overlying relation with respect to the flanges 58 and 60 of the associated body section side rail portion. The angle-bracket 52 is supported for longitudinal limited movement along the associated side rail portion by means of a guide pin 62 mounted on the bracket leg 54 and having guided movement longitudinally of a guide slot 64 formed in the side rail flange 58. Movement of the bracket 52 from the right end of the guide slot 64 in the folded position of the sofa-bed structure to the left end of the slot when in the bed forming position (FIG. 4), is accomplished by an actuating lever 66, one end of this lever being pivotally connected with the guide pin 62, and at its other end being pivotally connected by pivot pin 68 to the side rail of the intermediate section 18 in spaced relation to the pivot 50. As thus arranged, movement of the bracket 52 from the right end of the slot to the left end of the slot 64 is transmitted to the rod or rods 40 by means of a pulling link 70, one end of this link being connected with the leg 56 of the bracket 52, and the other end being connected with the contiguous end of the rod 40. It will be seen that this movement will result in a lateral movement of rod 40 from its phantom line position, as shown in FIG. 3, in which the spring 44 is relaxed, to the full line position in which the coil spring 44 will be tensioned, and thus bias the rod or rods 40 into effective relation with the adjacent mattress supporting fabric, and with which it coacts to provide a taut resistance to the mattress sag as well as its tendency to sag towards the center of the bed under the weignt of an occupant. When the sofa-bed structure is returned to a folded seat forming position, the tensioned springs 44 operate to return the rod members to their ineffective position so that the mattress supporting fabric may then function in its most desirable manner with respect to the quality of seating.

From the foregoing description, it is believed that it will be clearly apparent that the stated objectives will be obtained by the structure according to the foregoing description.

Various modifications may suggest themselves to those skilled in the art without departing from the spirit of my invention, and, hence, I do not wish to be restricted to the specific forms shown or uses mentioned, except to the extent indicated in the appended claims, wherein various portions have been separated for clarity of reading and not for emphasis.

I claim:

1. A mattress support mechanism for a folding sofa-bed frame having a plurality of sections including a body section, pivotally interconnected in end-to-end relation for movement into an extended planar position to form a bed, and into a folded position to form a sofa seat, comprising:

(a) a flexible mattress supporting fabric (32) in the frame body section (16) adapted in the extended bed forming position to sag under the weight of an occupant;

(b) means operative in the bed forming position for modulating the flexing movement of the fabric due to the weight of said occupant, comprising:

at least one elongate substantially rigid member (40) extending transversely essentially between the opposite sides of the frame of said body section (16) in underlying relation to said flexible mattress supporting fabric (32);

coiled springs (44) respectively connecting the ends of said rigid member (40) with adjacent side rails (22, 24) of the body section (16), and being operative to bias said rigid member (40) in a direction towards said adjacent flexible mattress supporting fabric (32); and (c) control means operative in the seat forming position for deactivating said modulating means, comprising:

slide members (52) respectively on said side rails (22, 24) in laterally spaced relation to the attached coiled springs (44);

pull links (70) respectively connecting the adjacent ends of said rigid member (40) with said slide members (52); and lever members (66) respectively having one end pivoted to the adjacent slide member (52) and its other end pivoted to the adjacent side rail of a frame section (18) pivotally connected with said body section (16).

* * * * *